US007603974B2

(12) United States Patent
Bertram

(10) Patent No.: US 7,603,974 B2
(45) Date of Patent: Oct. 20, 2009

(54) VARIABLE CAMSHAFT TIMING SYSTEM FOR AN INTERNAL COMBUSTION ENGINE

(75) Inventor: Ulrich Bertram, Bergheim (DE)

(73) Assignee: Ford Global Technologies, LLC, Dearborn, MI (US)

( * ) Notice: Subject to any disclaimer, the term of this patent is extended or adjusted under 35 U.S.C. 154(b) by 434 days.

(21) Appl. No.: 11/427,981

(22) Filed: Jun. 30, 2006

(65) Prior Publication Data

US 2007/0101960 A1 May 10, 2007

(30) Foreign Application Priority Data

Nov. 7, 2005 (EP) ..... 05110407

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 4,858,572 A 8/1989 Shirai et al.
5,293,845 A * 3/1994 Yamazaki et al. ..... 123/90.17
6,135,077 A * 10/2000 Moriya et al. ..... 123/90.17
6,155,220 A * 12/2000 Marriott ..... 123/90.17

FOREIGN PATENT DOCUMENTS

DE 19850947 5/2000
DE 10149759 A1 * 5/2003

* cited by examiner

*Primary Examiner*—Zelalem Eshete
(74) *Attorney, Agent, or Firm*—Julia Voutyras; Allan J. Lippa

(57) ABSTRACT

A system is disclosed which has a first camshaft coupled to a first gearwheel via a camshaft adjuster, the camshaft adjuster allowing the camshaft to be rotated with respect to the gearwheel, and a second camshaft fixedly coupled to a second gearwheel. The first and second gearwheels are coupled to a crankshaft via a belt or a chain. The camshaft adjuster is fixed to the first camshaft by a first fastener; the second gearwheel is fixed to the second camshaft by a second fastener. The fasteners are arranged at substantially the same depth, as assembled. The fasteners may be screws, adhesives, or welds. The second gearwheel includes: a gearwheel body having teeth, a disk-shaped body, and a spacer between the gearwheel basic body and the disk-shaped body, by which the axial length of the spacer causes the depth of the first and second fasteners to be substantially equivalent.

20 Claims, 4 Drawing Sheets

VARIABLE CAMSHAFT TIMING SYSTEM FOR AN INTERNAL COMBUSTION ENGINE

FIELD OF THE INVENTION

The invention relates to a system with at least one intake camshaft and with at least one exhaust camshaft which are equipped in each case, for the purpose of their drive, at one of their two ends and on the same side of the system with a gearwheel and which can thereby be set in rotation about their longitudinal axes by a rotating crankshaft by a belt or a chain, a first camshaft being equipped, for the adjustment of its control times, with a camshaft adjuster provided at that end of the first camshaft at which the gearwheel is also arranged, whereas a second camshaft does not have such a camshaft adjuster and consequently has fixed timing.

The invention relates, furthermore, to the use of such a system in an internal combustion engine having at least one cylinder.

BACKGROUND OF THE INVENTION

Camshaft adjustment is used on the intake side and/or exhaust side of an internal combustion engine to influences valve timing. The variation in valve timing is one approach to reduce fuel consumption, to reduce emissions, and/or to increase power.

On account of the limited resources of fossil fuels, there is a desire to minimize fuel consumption of internal combustion engines. Statutory regulations demand a constant reduction of pollutants emitted into the environment by internal combustion engines.

Fuel consumption and therefore efficiency present problems, particularly in spark ignition engines. The reason for this is the basic operating method of the spark ignition engine. The spark ignition engine operates with a homogeneous fuel/air mixture. The desired power is set by varying the filling of the combustion space, so that, in contrast to the diesel engine, the operating method of the spark ignition engine is based on quantity regulation.

Load control takes place by a throttle valve provided in the intake duct. By adjusting the throttle valve, the pressure of the intake air downstream of the throttle valve is affected. Quantity regulation by a throttle valve has thermodynamic disadvantages due to lower pressure and the associated throttle losses.

One approach to partially overcome throttling losses is to use a variable cam timing (VCT) drive. In conventional valve drives both the stroke of the valves and the opening and closing times of the intake and exhaust valves are invariable. But, with VCT, the valve opening and closing times can be altered so that a desired amount of air is inducted with a lesser need to throttle.

However, detectable fuel savings and therefore detectable pollutant reductions can also be achieved by only partially variable valve drives in which, for example, the closing time of the intake valve is adjusted. This measure—variation in the closing time of the intake valve—is likewise suitable for influencing the power or the torque of the internal combustion engine.

Moreover, in the case of a fully variable valve control, the quantity of the intake mixture can be controlled by the closing of the intake valve, the intake mixture being sucked in at ambient pressure, even in the case of a change of charge, in the part load range because of the absence of a throttle valve.

One possibility of varying the control times of the valves is to use VCT, by which the camshaft is rotated with respect to the crankshaft to advance or retard the valve events with respect to the crankshaft. Such VCT devices are designated below, in general, as camshaft adjusters, irrespective of the operating principle on which they are based.

VCTs are normally actuated or controlled hydraulically, one or more pressure chambers being acted upon by hydraulic oil in a directed manner. Such an adjustment device is described, for example, in the German laid-open publication DE 198 50 947 A1. The camshaft adjuster described in DE 198 50 947 A1 is equipped with an axially displaceable piston device, an axial displacement of the piston device implying a rotation of the camshaft with respect to a belt wheel driving the camshaft and, consequently, a rotation of the camshaft with respect to the crankshaft which is coupled in its rotational movement to the belt wheel via a belt.

To displace the piston device, two adjustment chambers are provided, which are acted upon with pressure oil for axial displacement.

The adjustment device described is merely one example of a camshaft adjuster which is formed by an axially displaceable piston device.

U.S. Pat. No. 4,858,572 describes an adjustment device which does not make use, like the device described above, of a piston device to rotate the camshaft with respect to the crankshaft. Instead, a vane-cell pump is employed for adjustment. One or more chambers is supplied with a fluid under pressure, and therefore like the adjustment device in DE 198 50 947 A1, is based on a hydraulic operating method.

A vane-cell pump 100 has an outer rotor 102 and an inner rotor 104 and as shown in FIG. 1. The outer rotor 102 rotates with external belt gearwheel 101; whereas, the inner rotor 104 is fixed to the camshaft 103. To rotate camshaft 103 with respect to the crankshaft and consequently vary valve timing, inner rotor 104 is rotated with respect to outer rotor 102, by introducting fluid into pressure chambers 105. The pressure chambers 105 are formed by the vanes 102*a*, 104*a* of the rotors 102, 104 and by the rotors 102, 104 themselves and are sealed off by sealing strips arranged at the ends of the vanes 102*a*, 104*a*. By providing pressurized oil into the pressure chambers 105, the inner rotor 104 rotates with respect to the outer rotor 102.

Both the intake camshaft and the exhaust camshaft may be equipped in each case with a separate camshaft adjuster. However, depending on the objective, it may also be expedient to provide only one adjustable camshaft, e.g., only the intake camshaft or the exhaust camshaft, the other camshaft having fixed valve timings.

If, for example, the aim is to achieve fuel savings, varying the intake camshaft only may prove to be sufficient, without a VCT device on the exhaust camshaft.

In other applications, the opposite procedure may seem appropriate, in which the exhaust camshaft is equipped with a camshaft adjuster, whereas there are fixed intake valve events.

Providing the various options leads to considerable problems during assembly since the existing production lines have one assembly line to assemble all variations: VCT on both intake and exhaust, VCT on one of intake or exhaust, and no VCT.

Where assembly is concerned, the rotary angle positions of the camshafts and of the crankshaft are set and synchronized, inter alia, in a special production station. The crankshaft is rotated until it butts against a predetermined positioning pin, the camshafts being capable of being positioned and synchronized in that they are rotated into the corresponding rotary angle position by notches provided at their free shaft ends. An engagement of a tool into the gearwheels arranged on the camshafts, if appropriate with the subsequent rotation of the corresponding camshaft, ensures the synchronization of the gearwheels.

If the camshafts are equipped with camshaft adjusters, the synchronization of the two camshaft adjusters, together with the gearwheels, typically takes place by a positioning tool which engages in position marks provided on the two camshaft adjusters, in such a way that the positioning tool can engage into the position marks in only a single predeterminable arrangement of the two camshaft adjusters in relation to one another.

After the positioning and synchronization of the camshafts and crankshaft have taken place successfully, the gearwheels or the camshaft adjusters are fixed by screws to fasten a gearwheel or a camshaft adjuster to the camshaft, a screw being screwed in the direction of the longitudinal axis of the camshaft. In this case, during assembly, a screw is screwed into the intake camshaft and a screw is screwed into the exhaust camshaft.

As regards the assembly situation where both camshafts are equipped with a camshaft adjuster or else neither camshaft has such a camshaft adjuster, the tools for the production station have the same engagement depth for screwing in the screws.

In internal combustion engines in which a camshaft adjuster for implementing variable control times is provided only on the exhaust side or only on the intake side and only a gearwheel is arranged on the other camshaft, the engagement depth of the tools for installing the fasteners is different, due to the depth of the camshaft adjuster being installed in one case and not in the other.

The production stations used at the present time for assembly often have only the possibility of assembling internal combustion engines in which the penetration depth of the tools for installing the fasteners is identical.

The provision of an internal combustion engine in which only the intake camshaft or only the exhaust camshaft is equipped with a camshaft adjuster would therefore necessitate an additional production station, the tools of which have the possibility of operating at different penetration depths. However, this measure would lead to considerable investment costs, specifically not only in terms of the procurement costs of an additional production station, but also in terms of the area or space requirement which would be necessary for setting up this additional production station and consequently for extending the existing production line.

The inventors of the present invention have recognized that the manufacture of assembly of an internal combustion engine would be simpler and less costly if the penetration depth for installing the gearwheel fasteners were a consistent depth regardless of whether it is a variable camshaft or a fixed camshaft.

SUMMARY OF THE INVENTION

Problems of the prior art are overcome by a system having a first camshaft coupled to a first gearwheel at a first end of the first camshaft via a camshaft adjuster, the camshaft adjuster allowing the camshaft to be rotated with respect to the gearwheel and a second camshaft fixedly coupled to a second gearwheel at a first end of the second camshaft. The first and second gearwheels are coupled to a crankshaft via a belt or a chain. The camshaft adjuster is fixed to the first camshaft by a first fastener, the second gearwheel is fixed to the second camshaft by a second fastener, and said first fastener and said second fastener are arranged when assembled at substantially the same depth as viewed in the direction of the camshaft longitudinal axes.

Embodiments of the system are in this case advantageous in which the first and second fasteners are screws. The use of screws for fastening the gearwheel or the camshaft adjuster makes it possible to apply the system according to the invention when use is made of conventional production lines and production stations in which, according to the prior art, screws are used as fasteners.

By providing the axial length to the second gearwheel according to the present invention, i.e., the assembly without a camshaft adjuster, the tools of the production station for installing the fasteners into the two camshafts have an identical penetration depth. This is achieved by a structural measure in which, in contrast to a conventional gearwheel, the second gearwheel is dimensioned in its axial dimension such that, in the assembled state, the screws are arranged essentially at the same depth, as seen in the direction of the camshaft longitudinal axes, that is to say the screw heads lie on a common virtual plane which runs perpendicularly with respect to the camshaft longitudinal axes.

The second gearwheel according to the invention, due to its comparatively large axial length, compensates for the space which would be occupied by the camshaft adjuster on the camshaft.

It is an advantage of the present invention that an internal combustion engine in which only the intake camshaft or only the exhaust camshaft is equipped with a camshaft adjuster, is delivered to a conventional production station which is designed originally for the assembly of internal combustion engines in which both camshafts are equipped with a camshaft adjuster, the second gearwheel can be mounted without modifications having to be made on the production station.

By the second gearwheel being designed according to the invention, the assembly operation for fastening the second gearwheel corresponds to the assembly operation for a camshaft adjuster. The tools operate in both instances with an identical penetration depth. Thus, a conventional production line or production station can be used to manufacture internal combustion engines having: intake and exhaust camshaft adjusters, an intake only adjuster, or an exhaust only adjuster.

Embodiments of the system are advantageous in which the intake camshaft forms the first camshaft which is equipped with a camshaft adjuster, and the exhaust camshaft forms the second camshaft which has invariable control times. As already stated further above, even partially variable control times on the intake side are expedient in terms of the lowering of fuel consumption, without it being necessary at the same time to make the control times of the exhaust valves variable. In this case, in particular, the variation in the closing time of the intake valve proves to a suitable measure for reducing fuel consumption. The control time at which the intake valve closes influences the filling of the combustion space and therefore also the torque characteristic of the internal combustion engine.

At low rotational speeds, it is advantageous to close the intake valve early, although, at high rotational speeds, particularly at the nominal rotational speed, this leads to unwanted filling losses. At high rotational speeds, therefore, it is preferred to close the intake valve late, in order to ensure a good filling of the combustion space in this rotational speed range. However, a late closing of the intake valve leads to filling losses at low rotational speeds due to the partial expulsion of the freshly sucked-in cylinder charge. These concurrent requirements of different rotational speeds can both be fulfilled, using a camshaft adjuster by which the control time at which the intake valve closes can be controlled variably. At low rotational speeds, the intake valve is closed early and at high rotational speeds it is closed late, this being implemented by a rotation of the camshaft with respect to the crankshaft by the camshaft adjuster. The control times of the exhaust camshaft may in this case remain unaffected.

Variable control times on the intake side likewise make it possible to vary what is known as the valve overlap, that is to say the crank angle range in which the exhaust valve is not yet closed when the intake valve is open. In the region of this valve overlap, scavenging losses may occur, part of the sucked-in mixture flowing through the combustion space, without participating in combustion. This leads, on the one hand, to lower efficiencies, but, on the other hand, to a higher cylinder filling and consequently to a higher power. At low rotational speeds, the aim is a smaller valve overlap, and at high rotational speeds the aim is a larger valve overlap. A variable closing time of the intake valve makes it possible to vary the valve overlap as a function of the rotational speed.

Embodiments of the system are advantageous in which the camshaft adjuster is designed as a vane-cell camshaft phase adjuster. Embodiments of the system are also advantageous, however, in which the camshaft adjuster is formed by an axially displaceable piston device.

The system according to the invention may be employed both with internal combustion engines in which a vane-cell pump serves as a camshaft adjuster, but also, if a camshaft adjuster is used, in which the operating principle is based on an axially displaceable piston device. In both instances, it is relevant to solve the assembly problems, discussed further above in the introduction, with regard to the penetration depth of the assembly tools, the design according to the invention of the second gearwheel proving expedient independent of the type of camshaft adjuster used.

Embodiments of the system are advantageous in which the second gearwheel is constructed in a modular manner from at least two components. The modular type of construction has advantages, because the second gearwheel has to perform a plurality of different functions, and, in this way, the at least two components can be designed according to their respective function. In the same way as a conventional gearwheel, the gearwheel has to receive the gearwheel teeth which are brought into engagement with a drive chain or a drive belt to be set in rotation by a rotating crankshaft. The second gearwheel must span or bridge a predeterminable axial distance along the camshaft longitudinal axis of the second camshaft so that, the first fastener and the second fastener are arranged essentially at the same depth, as viewed in the direction of the camshaft longitudinal axes, or perpendicular with respect to the camshaft longitudinal axes.

For the reasons mentioned, embodiments of the system are also advantageous in which the second gearwheel has at one end a gearwheel basic body for receiving teeth and has a spacer piece, by the axial length of which the axial position of the second fastener can be set in the assembled state. Embodiments of the system are advantageous, in particular, in which the second gearwheel has at one end a gearwheel basic body for receiving the teeth and has a disk-shaped body at the other end lying opposite the gearwheel basic body, a spacer piece being provided between the gearwheel basic body and the disk-shaped body, by the axial length of which spacer piece the axial position of the second fastener can be set in the assembled state.

In this case, embodiments of the system are advantageous in which the camshaft adjuster and the disk-shaped body have in each case position marks which are arranged in such a way that the first gearwheel and the second gearwheel can be connected to one another by a positioning tool in only one predeterminable arrangement in relation to one another, the connection being implementable in that the positioning tool engages into the position marks. The position marks may in this case be designed in the form of recesses or in the shape of projections.

In embodiments of the system in which the second gearwheel is constructed in a modular manner, the individual components may basically be connected releasably to one another, for example by a screw connection, a shrink-fit connection with a press fit or a snap connection. Embodiments of the system are advantageous in which the at least two components are connected unreleasably to one another, which may take place, for example, due to the introduction of a welded joint or an adhesive bond. Furthermore, however, it is also possible to design the second gearwheel as a monolithic component, for example as a casting or forging. Embodiments of the system are advantageous in which a bushing is provided between the second gearwheel and the second camshaft. The reasons are as follows.

If, starting from an internal combustion engine in which both camshafts are equipped with a camshaft adjuster, a camshaft adjuster for implementing variable control times is provided on the first camshaft and a gearwheel is arranged, instead of a second camshaft adjuster, on the second camshaft, the result may be that a modification of the camshaft end which was originally designed for receiving the second camshaft adjuster becomes necessary. What is responsible for this is that a recess in the camshaft adjuster for receiving the camshaft end has a smaller diameter than the bore of the gearwheel to be mounted, so that, if the camshaft adjuster is replaced by a gearwheel, the bore of the gearwheel to be mounted, on the one hand, and the camshaft end, on the other hand, are of different diameter.

The arrangement of a bushing between the second gearwheel and the second camshaft is suitable for compensating for this diameter difference. In a preferred embodiment of the system, the bushing may be connected unreleasably or releasably to the second gearwheel or produced in one piece with this gearwheel.

Embodiments of the system are in this case advantageous in which a seal is provided between the bushing and the second camshaft. A seal is required, so that the oil introduced into the system to lubricate the camshaft does not emerge at the connection point of the camshaft and second gearwheel and lead to the contamination of the surrounding components and of the surrounding area. The gearwheel itself is not a barrier to the emerging oil, because the gearwheel is preferably produced from sintered metal which is porous and therefore oil-permeable.

Embodiments of the system are advantageous in which the gearwheels are belt gearwheels. This embodiment takes into account the fact that belt drives are increasingly employed.

Systems of a type described above can be used in an internal combustion engine with at least one cylinder and are then defined in that, by the at least one intake camshaft and the at least one exhaust camshaft, control members of the internal combustion engine are actuated, by which the change in charge of the at least one cylinder of the internal combustion engine is controlled, the camshaft adjuster being used for at least partially varying the control times of the charge change.

BRIEF DESCRIPTION

The invention is described in more detail below, with reference to an exemplary embodiment, according to FIGS. 1 to 4 in which.

DETAILED DESCRIPTION

Figure 1:
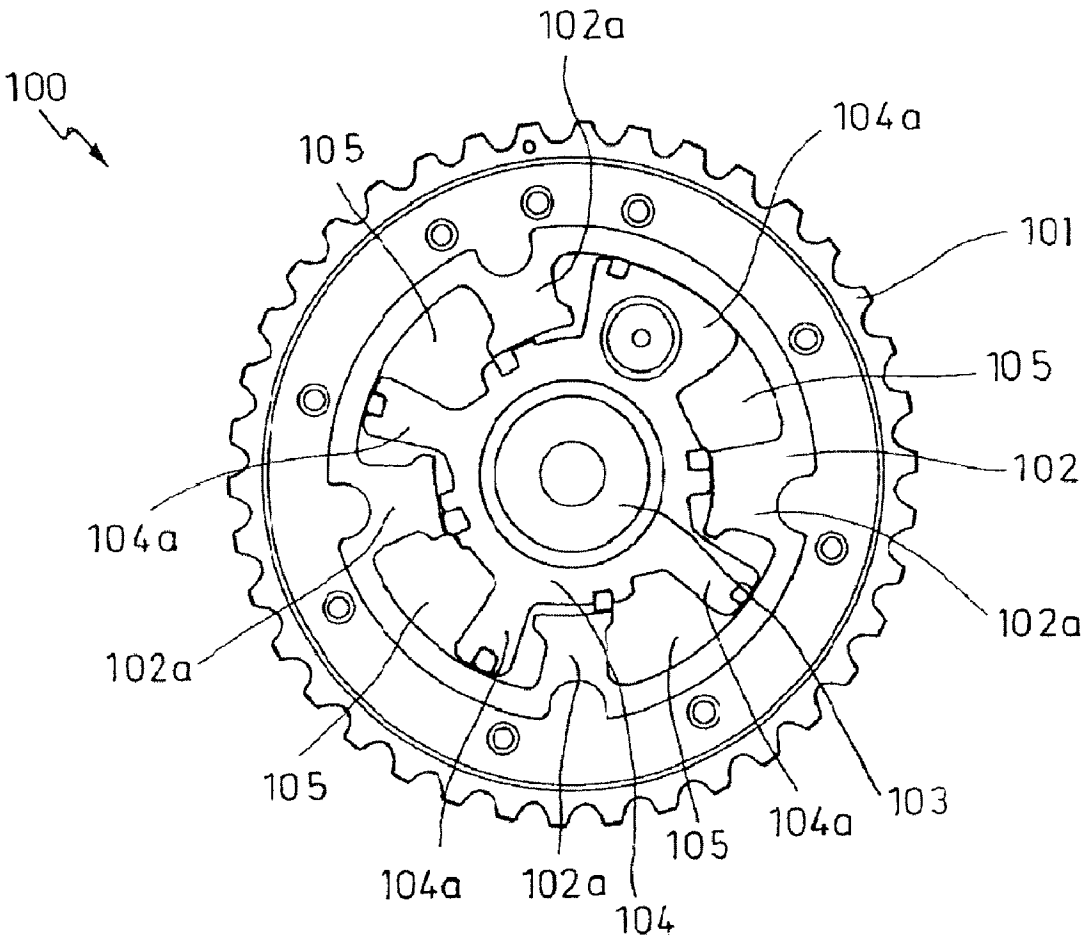
Fig.1 Prior Art
FIG. 1 shows a vane-cell pump in cross section according to the prior art.
Figure 2:
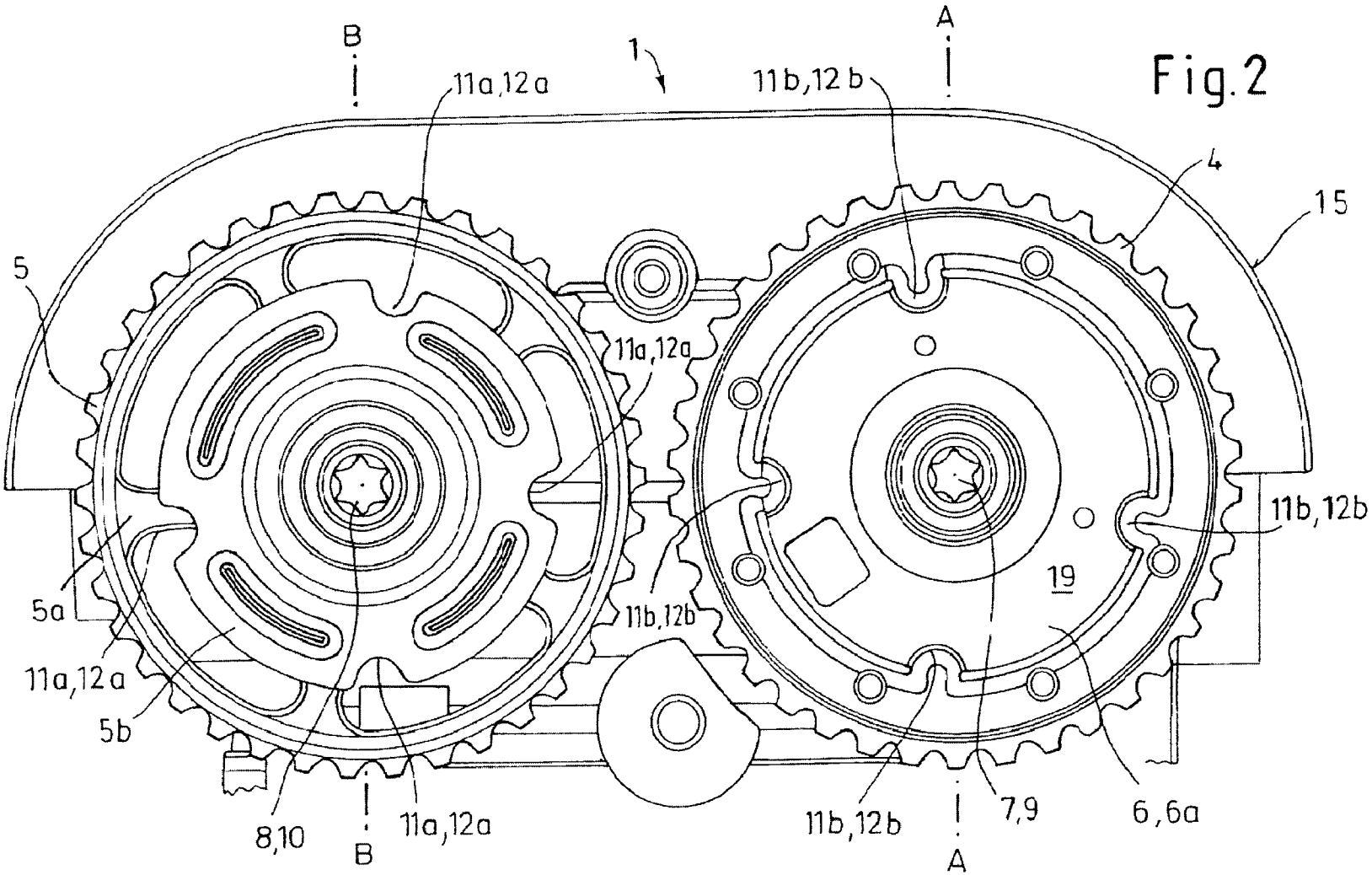
FIG. 2 shows a side view of an embodiment of the system, as seen in the direction of camshaft longitudinal axes.

The system 1 has an intake camshaft and an exhaust camshaft, neither camshaft being visible in the side view shown in FIG. 2. A first gearwheel 4 and a camshaft adjuster 6 are provided at the end of the intake camshaft, whereas only a gearwheel 5, which may be designated as a second gearwheel 5, is arranged at the end of the exhaust camshaft.

Both gearwheels 4, 5 are designed as belt gearwheels, are arranged on the same side of system 1 and coupled to a crankshaft, not illustrated, by a belt, likewise not illustrated. This belt drive is protected by a cover 15 which is arranged above the two gearwheels 4, 5.

The camshaft adjuster 6, together with the first gearwheel 4, is fixed to the end of the intake camshaft by a fastener 7. The second gearwheel 5 is fastened to the end of the exhaust camshaft by a fastener 8. The fasteners may preferably be screws.

The second gearwheel 5 is constructed in a modular manner and has, inter alia, a gearwheel basic body 5*a* for receiving the teeth which, when the internal combustion engine is rotating, engage with a belt and thereby drive the camshaft. Furthermore, the second gearwheel 5 has a disk-shaped body 5*b*. The construction of the second gearwheel 5, the gearwheel basic body 5*a*, and the disk-shaped body 5*b* are evident from FIG. 4 and are described in more detail below.

Figure 3:
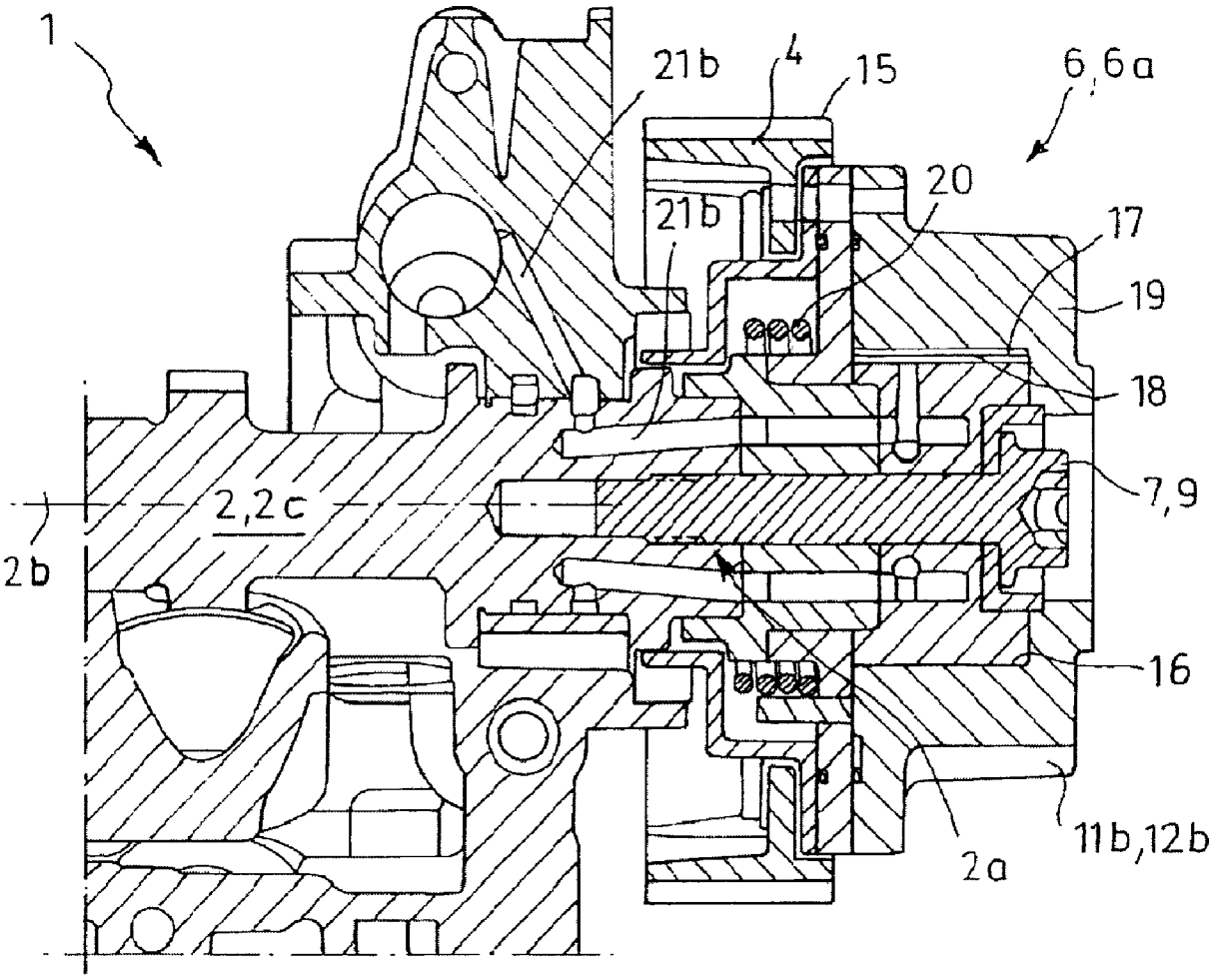
FIG. 3 shows a section along the line A-A marked in FIG. 2.

The camshaft adjuster 6 is a vane-cell type and discussed in conjunction with FIG. 3.

The housing 19 of the camshaft adjuster 6 and the disk-shaped body 5*b* of the second gearwheel 5 have in each case four position marks 11*a*, 11*b* in the form of semicircular recesses 12*a*, 12*b* which are arranged on the outer circumference of the housing 19 or of the disk-shaped body 5*b*. In this case, the position marks 11*a*, 11*b* are distributed on the corresponding circumference irregularly, so that the two gearwheels 4, 5 can be connected to one another by a positioning tool, which engages into the position marks 11*a*, 11*b*, in only one predeterminable arrangement in relation to one another.

FIG. 3 illustrates a section along the line A-A marked in FIG. 2. The camshaft adjuster 6 of the embodiment illustrated in FIG. 3 operates on the principle of a vane-cell pump 6*a* having an outer rotor 17 and an inner rotor 16. When screw 9 is tight, the inner rotor 16 is braced firmly together with the first camshaft 2*c*. Thus, when the internal combustion engine is in operation, the inner rotor 16 rotates together with the intake camshaft 2 about the camshaft longitudinal axis 2*b*. The outer rotor 17 is produced in one piece with the housing 19 of the camshaft adjuster 6, so that, as assembled, the outer rotor is connected fixedly to the first belt gearwheel 4. The two rotors 16, 17 are connected to one another via a helical spring 20, to prevent a random rotation of the two rotors 16, 17 with respect to one another and to provide a predeterminable return force.

To rotate the camshaft 2 with respect to the crankshaft and consequently vary the cam timing, the inner rotor 16 is rotated with respect to the outer rotor 17 by introducing hydraulic oil into a plurality of pressure chambers, not shown. For this purpose, oil supply bores 21*b* are provided, which lead through the intake camshaft 2 and issue at the end 2*a* of the camshaft 2 into the pressure chambers of the camshaft adjuster 6, so that the pressure chambers can be supplied with oil. The pressure chambers, which cannot be seen in the section illustrated in FIG. 3, are formed between the vanes of the two rotors 16, 17 and are sealed off by sealing strips 18. By introducing pressurized oil into the pressure chambers, the two vanes delimiting a pressure chamber are pressed apart and the chamber volume is increased. In this way, the inner rotor 16 is rotated with respect to the outer rotor 17 or the camshaft 2 connected fixedly in terms of rotation to the inner rotor 16 is adjusted with respect to the first gearwheel 4 and therefore with respect to the crankshaft.

Figure 4:
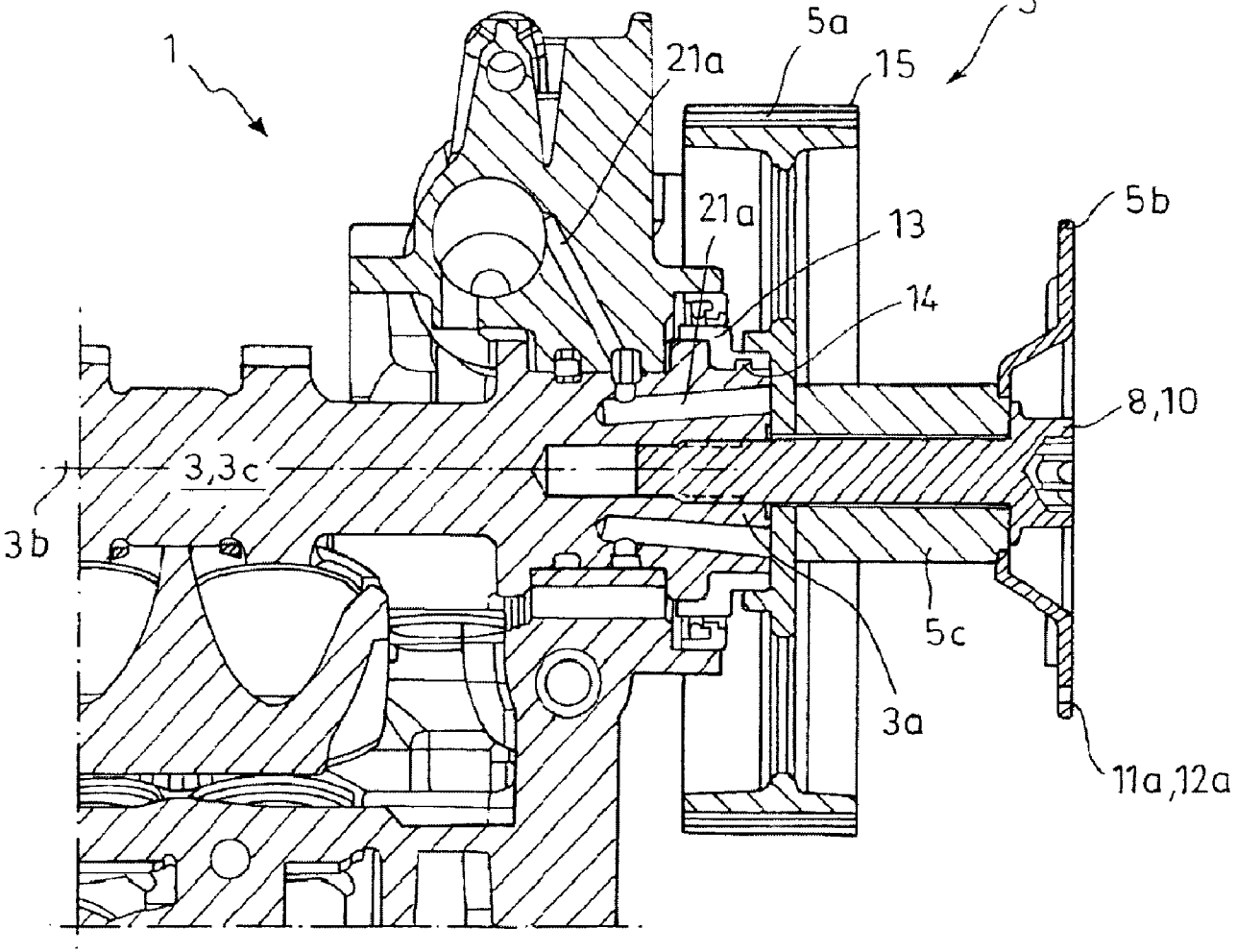
FIG. 4 shows a section along the line B-B marked in FIG. 2.

FIG. 4 shows a section along the line B-B marked in FIG. 2. The construction and functioning of the second gearwheel 5 which is arranged on the end 3*a* of the exhaust camshaft 3 are dealt with below. As assembled, the second gearwheel 5 is firmly braced to the second camshaft 3*c*. When the internal combustion engine rotates, the exhaust camshaft 3 also rotates in a fixed rotational relationship with the crankshaft.

The second gearwheel 5 is constructed in a modular manner and has at one end a gearwheel basic body 5*a* for receiving the teeth and at the other end, lying opposite the gearwheel basic body 5*a*, a disk-shaped body 5*b*. In the same way as the housing of the camshaft adjuster, the disk-shaped body 5*b* has position marks 11*a* in the form of semicircular recesses 12*a*. Between the gearwheel basic body 5*a* and the disk-shaped body 5*b*, a spacer piece 5*c* is provided.

The use of the spacer piece 5*c* ensures that, in the assembled state of the system 1, the first fastener 9 and the second fastener 10 are arranged essentially at the same depth, as seen in the direction of the camshaft longitudinal axes 2*b*, 3*b*, that is to say lie on a common virtual plane perpendicular with respect to the camshaft longitudinal axes 2*b*, 3*b* (see also FIG. 3), thus leading to an essentially identical penetration depth of the tools for mounting the fasteners 9, 10. The individual components 5*a*, 5*b*, 5*c* of the second gearwheel 5 are connected to one another by a welded joint (not illustrated) in one embodiment.

A bushing 13 is provided between the second gearwheel 5 and the second camshaft 3*c*, at the end 3*a* of the camshaft 3. This makes it possible to interchange parts between an internal combustion engine in which both camshafts 2, 3 are equipped with a camshaft adjuster, without comprehensive modifications being required on the internal combustion engine, in particular on the exhaust camshaft 3, which would result in the absence of a cam phase adjuster 6. In particular, an exhaust camshaft 3 may be used which has oil supply bores 21*a*, although these would basically not be required as a result of the absence of a camshaft adjuster.

To arrange a gearwheel 5 on the end 3*a* at the exhaust camshaft 3 instead of a second camshaft adjuster for implementing variable control times on the exhaust side, the diameter difference between the recess of the camshaft adjuster for receiving the camshaft end 3*a* and the reception bore of the gearwheel 5 to be mounted must be bridged, that is to say compensated, so that the bore of the gearwheel 5 to be mounted can be pushed with an exact fit onto the end 3*a* of the camshaft 3, with the bushing 13 being interposed. The bushing 13 may be produced in one piece with the second gearwheel 5 or as two separate parts. A seal 14 is provided between the bushing 13 and the end 3*a* of the second camshaft 3, to prevent oil leakage.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

We claim:

1. A system (1), comprising:

a first camshaft (2) coupled to a first gearwheel (4) at a first end of the first camshaft (2*a*) via a camshaft adjuster (6), the camshaft adjuster (6) allowing the first camshaft to be rotated with respect to the first gearwheel (4); and a second camshaft (3) fixedly coupled to a second gearwheel (5) at a first end of the second camshaft (3*a*), the first and second gearwheels being coupled to a crankshaft via a belt or a chain wherein the camshaft adjuster (6) is fixed to the first camshaft (2*c*) by a first fastener (7), the second gearwheel (5) is fixed to the second camshaft (3*c*) by a second fastener (8), wherein the second gearwheel (5) has at one end a gearwheel basic body (5*a*) for receiving teeth and has a disk-shaped body (5*b*) at an opposite end of said gearwheel basic body (5*a*), a spacer piece (5*c*) being provided between the gearwheel basic body (5*a*) and the disk-shaped body (5*b*), by which the axial length of said spacer piece the axial position of the second fastener (8) can be set in the assembled state, and wherein said first fastener (7) and said second fastener (8) are arranged, as assembled, at substantially the same depth.

2. The system (1) of claim 1, wherein the first and second fasteners are screws.

3. The system of claim 1 wherein the first camshaft is an intake camshaft and the second camshaft is an exhaust camshaft.

4. The system of claim 1 wherein the first camshaft is an exhaust camshaft and the second camshaft is an intake camshaft.

5. The system of claim 1 wherein the camshaft adjuster is a vane-cell camshaft phase adjuster.

6. The system of claim 1 wherein the camshaft adjuster is an axially displaceable piston device.

7. The system of claim 1 wherein the second gearwheel is constructed in a modular manner from at least two components.

8. The system of claim 7 wherein the at least two components are permanently affixed to one another.

9. The system (1) of claim 1 wherein the camshaft adjuster (6) and the disk-shaped body (5*b*) each have position marks (11*a*, 11*b*) which are arranged so that the first gearwheel (4) and the second gearwheel (5) can be connected to one another by a positioning tool in only one arrangement in relation to one another, the positioning tool engaging into the position marks (11*a*, 11*b*).

10. The system (1) of claim 1, further comprising: a bushing (13) provided between the second gearwheel (5) and the second camshaft (3*c*).

11. The system (1) of claim 10, wherein a seal (14) is provided between said bushing (13) and the second camshaft (3*c*).

12. The system (1) of claim 1 wherein the first and second gearwheels (4, 5) are belt driven.

13. The system (1) of claim 1 wherein the first and second gearwheels (4, 5) are chain driven.

14. The system (1) of claim 1 wherein said same depth is determined as viewed in the direction of the camshaft longitudinal axes (2*b*, 3*b*).

15. A system (1), comprising a first camshaft (2) coupled to a first gearwheel (4) at a first end of the first camshaft (2*a*) via a camshaft adjuster (6), the camshaft adjuster (6) allowing the camshaft to be rotated with respect to the gearwheel (4); and a second camshaft (3) fixedly coupled to a second gearwheel (5) at a first end of the second camshaft (3*a*), the first and second gearwheels being coupled to a crankshaft via a belt or a chain, wherein the camshaft adjuster (6) is fixed to the first camshaft (2*c*) by a first screw, the second gearwheel (5) is fixed to the second camshaft (3*c*) by a second screw, and said first screw and said second screw are arranged, as assembled, at substantially the same depth as viewed perpendicular to their axes and wherein the second gearwheel (5) has at one end a gearwheel basic body (5*a*) having teeth and has a disk-shaped body (5*b*) at an opposite end of said gearwheel basic body (5*a*), a spacer piece (5*c*) being provided between the gearwheel basic body (5*a*) and the disk-shaped body (5*b*), by which the axial length of said spacer piece the axial position of the second fastener (8) can be set in the assembled state.

16. A system (1) having a first camshaft (2) coupled to a first gearwheel (4) at a first end of the first camshaft (2*a*) via a camshaft adjuster (6), the camshaft adjuster (6) allowing the camshaft to be rotated with respect to the gearwheel (4) and a second camshaft (3) fixedly coupled to a second gearwheel (5) at a first end of the second camshaft (3*a*), the first and second gearwheels being coupled to a crankshaft via a belt or a chain, wherein the second gearwheel (5) comprises: a basic body (5*a*) having teeth, a disk-shaped body (5*b*), and a spacer piece (5*c*) located between said basic body (5*a*) and said disk-shaped body; the camshaft adjuster (6) is fixed to the first camshaft (2*c*) by a first fastener (7), the second gearwheel (5) is fixed to the second camshaft (3*c*) by a second fastener (8), and said first fastener (7) and said second fastener (8) are arranged, as assembled, at substantially the same depth.

17. The system (1) of claim 16 wherein a length of said spacer piece (5*c*) causes said first and second fasteners (7, 8) to be installed at said same depth.

18. The system of claim 16 wherein said first and second fasteners (7, 8) are screws and said same depth is determined by viewing perpendicular to the axes of said first and second fasteners(7, 8).

19. The system of claim 16 wherein said first and second fasteners are welds.

20. The system of claim 16 wherein said first and second fasteners are adhesives.

* * * * *